US006711362B2

(12) United States Patent
Asakura

(10) Patent No.: US 6,711,362 B2
(45) Date of Patent: Mar. 23, 2004

(54) IMAGE FORMING APPARATUS AND PROCESS UNIT IDENTIFICATION METHOD OF THE IMAGE FORMING APPARATUS

(75) Inventor: Masanori Asakura, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/209,403

(22) Filed: Jul. 30, 2002

(65) Prior Publication Data

US 2003/0031475 A1 Feb. 13, 2003

(30) Foreign Application Priority Data

Aug. 9, 2001 (JP) ..... 2001-241581

(51) Int. Cl.[7] ..... G03G 15/00
(52) U.S. Cl. ..... 399/12; 13/25
(58) Field of Search ..... 347/19, 49, 86; 399/12, 13, 24, 25, 27

(56) References Cited

U.S. PATENT DOCUMENTS 6,019,461 A * 2/2000 Yoshimura et al. ..... 347/86

FOREIGN PATENT DOCUMENTS

JP 10-069139 3/1998
JP 2001-255724 9/2001

* cited by examiner

*Primary Examiner*—Hoang Ngo
(74) *Attorney, Agent, or Firm*—Hogan & Hartson, LLP

(57) ABSTRACT

The present invention provides an image forming apparatus including a process unit inserted in and removed from the image forming apparatus. The process unit includes a first memory having an identification code and a count value stores therein. The image forming apparatus also includes a memory access unit that accesses the first memory and reads the identification code and the count value and a second memory that stores an identification code and a count value of the image forming apparatus. A control unit limits an image forming operation if the identification code stored in the first memory matches the identification code stored in the second memory and the count value stored in the first memory has a predetermined relation with the count value of the second memory.

23 Claims, 6 Drawing Sheets

1
MPU
2
L
NCU
ROM
8
9
RAM
USER ID CODE
9a
CONSUMABLE SUPPLIES COUNTER
9b
3
MODEM
4
SCANNER
10
IMAGE MEMORY
5
KEYPAD
11
CODEC
12
6
DISPLAY PART
PRINT IMAGE PROCESSING CIRCUIT
7
LAN I/F
13
LED PRINT HEAD
15
21
22
PC
SERVER
PRINT MECHANISM CONTROL UNIT

IMAGE FORMING APPARATUS AND PROCESS UNIT IDENTIFICATION METHOD OF THE IMAGE FORMING APPARATUS

BACKGROUND OF THE INVENTION

1. Field of the Invention

The present invention relates to an image forming apparatus and a process unit identification method used in multifunction peripherals and facsimile apparatus.

2. Description of the Related Art

Process units such as toner cartridges and drum units can be inserted into or removed from an image forming apparatus, and are replaced when the life of the process unit expires.

In recent years, non-genuine (hereinafter called "pirated") process units have gone into circulation, and there has been a problem that image quality cannot be guaranteed if a pirated process unit is used in an image forming apparatus. A technique, allowing a print operation of the image forming apparatus for the genuine process units uses a specific code data read from a memory unit of the process unit. When specific code data is stored in the memory unit, and the process unit is inserted into the apparatus, this solves the above problem.

However, this technique cannot be applied to the pirated process units made by recycling used genuine process units.

The present invention is provided in view of the above problem, and it is an advantage of the present invention to provide the image forming apparatus where pirated process units made from recycled used genuine process units cannot be used.

SUMMARY OF THE INVENTION

To solve the above problem, an image forming apparatus of the present invention includes a first memory where an ID (Identification) code and a count value are written, a process unit that can be inserted in and removed from the image forming apparatus, a memory access unit which can access the first memory to read out the ID code and read out and write the count value, and a second memory where the image forming apparatus stores the ID code and the count value, and further includes a control unit which limits an image forming operation of the image forming apparatus if the ID code of the first memory matches the ID code of the second memory and the count value of the first memory has a predetermined relation to the count value of the second memory.

As the count value stored in the second memory of the image forming apparatus changes every time the process unit is exchanged, the count value set in the first memory of the used process unit does not match the count value stored in the second memory of the image forming apparatus if the process unit including the count value used before is fixed in the apparatus, and the image forming apparatus can recognize that the fixed process unit is the recycled pirated one.

In the configuration, an image forming operation is not carried out when the control unit determines that the process unit is pirated, as the control unit limits the image forming operation of the image forming apparatus if the ID code of the first memory does not match the ID code of the second memory, so that problems such as deteriorating image quality, etc. can be surely prevented.

Moreover, an embodiment for changing the count value stored in the second memory of the image forming apparatus every time the process unit is exchanged is provided. The control unit changes the count value stored in the second memory and writes it in the first memory, when the ID code of the first memory matches the ID code of the second memory and the memory access unit does not read out the count value. This occurs on the condition that the count value is not written in the first memory in an initial state.

DETAILED DESCRIPTION OF THE INVENTION

Hereinafter, the present invention will be described in more detail with reference to a preferred embodiment.

Figure 1:
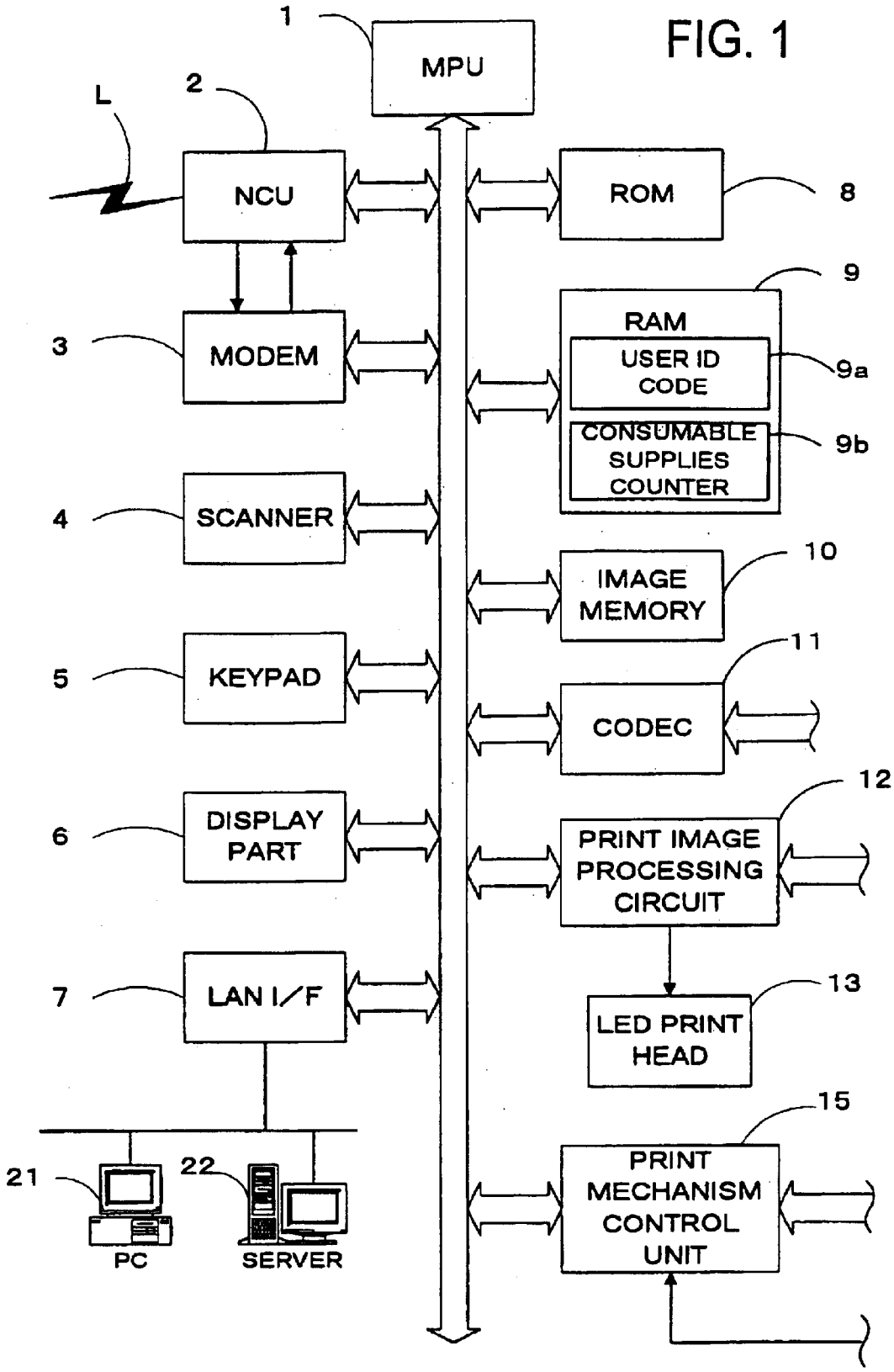
FIG. 1 is a block diagram of an image forming apparatus according to a preferred embodiment.
Figure 2:
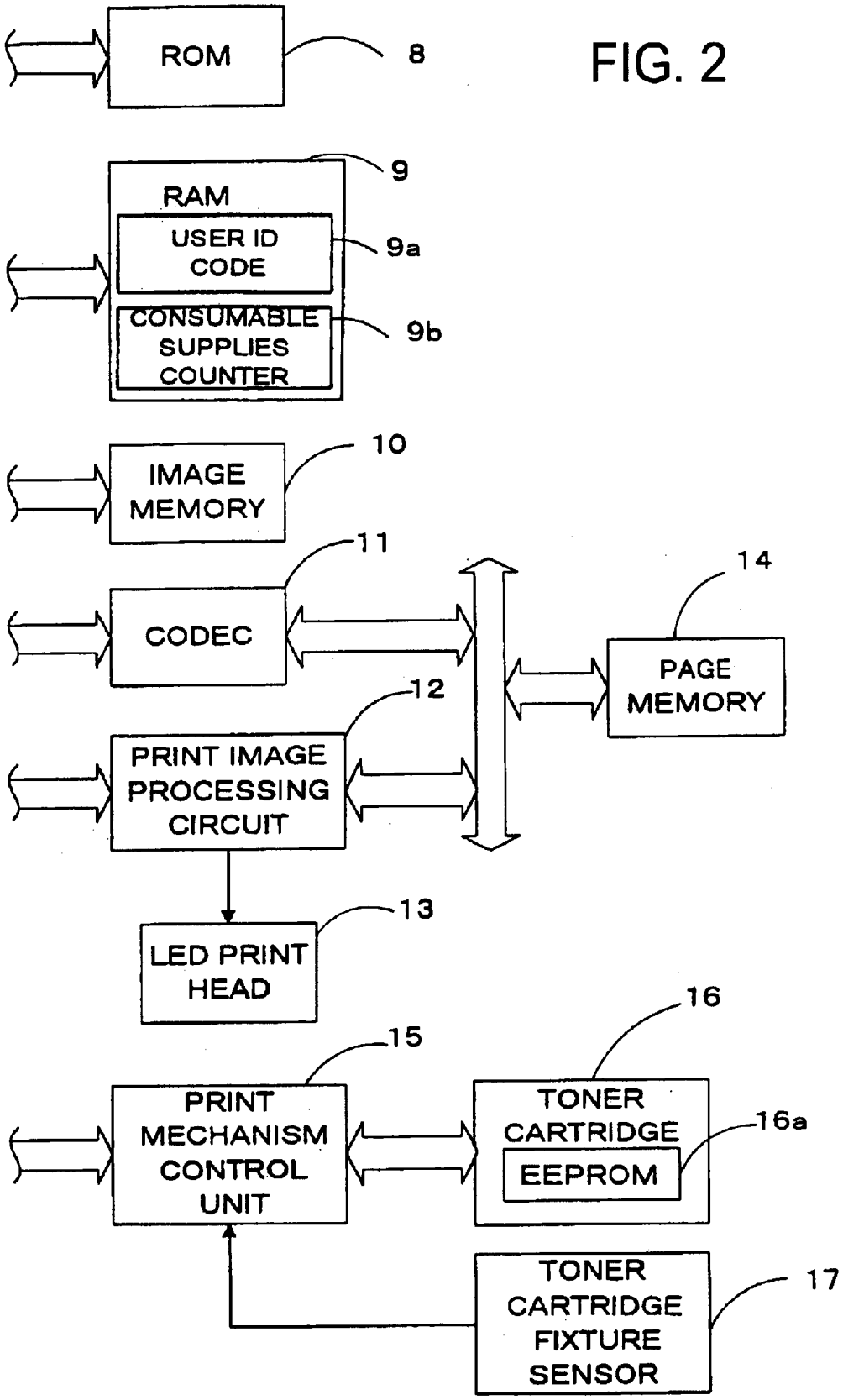
FIG. 2 is a block diagram of an expanded view of the image forming apparatus of FIG. 1.

A block diagram showing an example of an image forming apparatus according to the preferred embodiment is illustrated in FIG. 1 and FIG. 2. Here, a multifunction peripheral device having both copy and facsimile functions is taken as an example of the image forming apparatus.

According to FIG. 1, a MPU (micro processing unit) 1 functions as a control unit of the multifunction peripheral device, and a NCU (network control unit) 2 and a MODEM 3 are connected to the MPU 1. The NCU 2, controlled by the MPU 1, controls to connect a line L to the multifunction peripheral, and has a function of transmitting a dial pulse in accordance with a telephone number of a destination and a function of detecting an incoming call. Additionally, the line L is connected to a public switched telephone network not shown in the drawings. The MODEM 3 modulates and demodulates transmitting and receiving data. More specifically, the MODEM 3 modulates transmit data that is originally a digital signal into an analogue audio signal and transmits it to the line L through the NCU 2, and demodulates the analogue audio signal received from the line L through the NCU 2 into the digital signal.

Moreover, a scanner 4, a keypad 5, a display part 6, a LAN I/F (Local Area Network) 7, a ROM 8, a RAM 9, an image memory 10, a CODEC (Coder and Decoder) 11, a print image processing circuit 12, and a print mechanism control unit 15 serving as a memory access unit are connected to the MPU 1.

The scanner 4 reads a document image using a CCD image sensor or the like. The keypad 5 includes a numerical keypad for inputting numbers of a telephone number and a facsimile number, etc. and a function key for directing various operations. The display part 6 displays a softcopy of various information including a telephone number and a facsimile number input by the operation of the keypad 5 and the residual quantity of the toner in the printer. A CRT display and a LCD (Liquid Crystal Display) are used as the display part 6. The LAN I/F 7 is provided for connecting to a LAN 20 that a personal computer (PC) 21 and a server 22 are connected.

The ROM 8 stores a program, etc. for controlling an operation of the entire multifunction peripheral device. The RAM 9 stores data, etc. necessary for being controlled by the MPU 1 and temporarily stores data during a control operation. Moreover, the RAM 9 includes a user ID code 9*a* for storing the ID code of the process unit and a consumable supplies counter 9*b* for storing the count value of the process unit. The image memory 10 stores image data read by the scanner 4 and image data received from the outside through the line L and the MODEM 3.

The CODEC (Coder and Decoder) 11 encodes image data to be transmitted that is stored in a page memory 14 and decodes the received image data to memorize in the page memory 14. The print image processing circuit 12 records the received image data, the image data read by the scanner 4, or the image data stored in the page memory 14 by printing the image data on paper, and processes the image data for outputting a hard copy of the image data. Moreover, the print image processing circuit 12 controls an exposure operation of an LED print head 13 serving as an exposure unit of the printer.

The print mechanism control unit 15 reads out the ID code, and reads out and writes the count value stored in an EEPROM 16*a* serving as the first memory that is provided in a toner cartridge 16 serving as the process unit. Moreover, a detection signal of a toner cartridge fixture sensor 17 that detects whether or not the toner cartridge 16 is fixed in the multifunction peripheral is input in the print mechanism control unit 15.

Next, the operation principle when exchanging the toner cartridge 16 (the process unit) in the multifunction peripheral will be described with reference to FIG. 3 and FIG. 4. The user ID code is stored in the EEPROM 16*a* of the toner cartridge 16 in advance, wherein the consumable supplies count value is not written in advance. In an example of FIG. 3(*a*), the user ID code is adjusted to the code which can be managed by users (such as the facsimile number), and the consumable supplies count value is adjusted to "0", etc. at the beginning when installing a main body 30 of the peripheral. The user ID code and the consumable supplies count value are registered in the EEPROM 16*a* at an agency or a service center when installing the main body 30 of the peripheral. More specifically, here, the user ID code is made to be "ABC", and the consumable supplies count value is made to be "*" in an initial condition, "0" when installing the apparatus, and the number of the count value is increased one by one such as 1, 2, 3, . . . every time exchanging the toner cartridge.

Figure 3A:
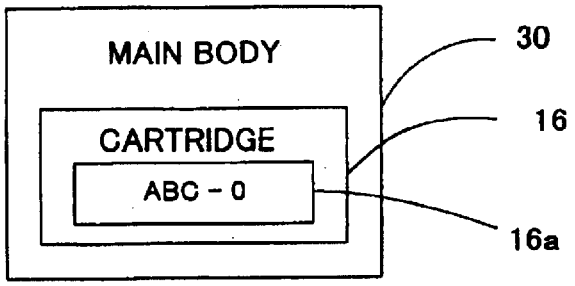
FIG. 3 is a diagram illustrating an operation principle in exchanging a toner cartridge (a process unit) of the image forming apparatus.
Figure 3B:
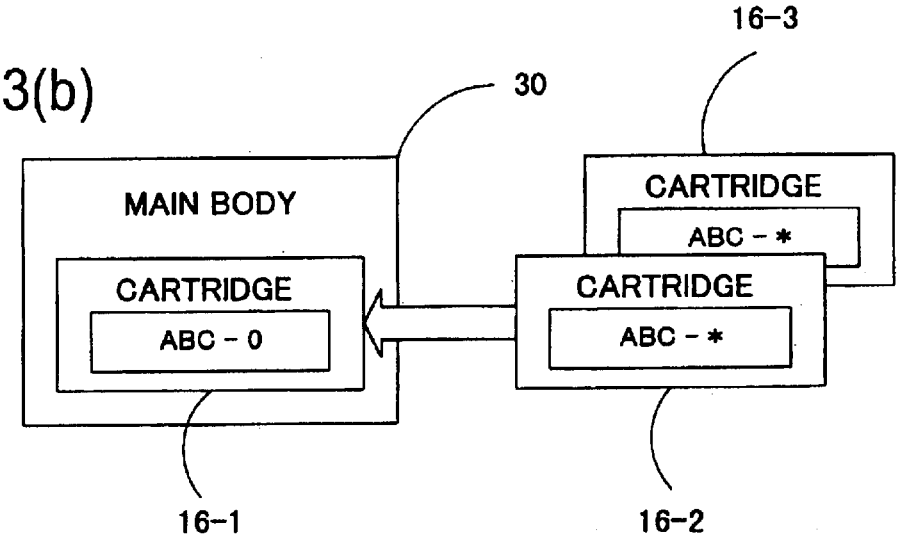
Figure 3C:
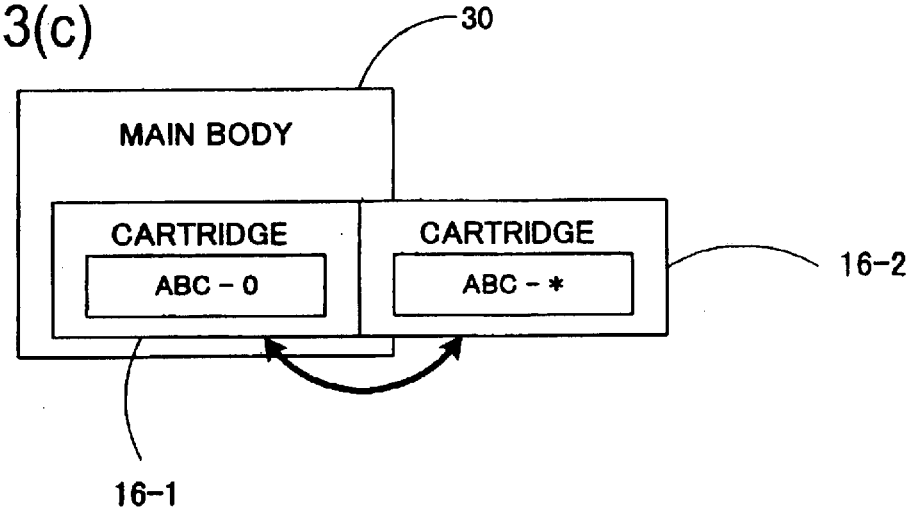

According to FIG. 3(*b*), after installing the peripheral, a first toner cartridge 16-1 is fixed in the main body 30 of the peripheral, and the code "ABC-0" is stored in the EEPROM 16*a* in the toner cartridge 16-1. The toner cartridge 16-1 is exchanged with a next toner cartridge 16-2 when the toner in cartridge 16-1 is used up. First, however, the user ID code stored in the EEPROM 16*a* of the new toner cartridge 16-2 is checked against the user ID code in the old toner cartridge 16-1. As the code "ABC-*" is stored in the EEPROM 16*a* if the new toner cartridge 16-2 is not pirated, the user ID codes "ABC" of the new and old toner cartridges 16-1 and 16-2 should be the same. Moreover, the user ID codes are not the same if the new toner cartridge 16-2 is pirated.

Figure 4A:
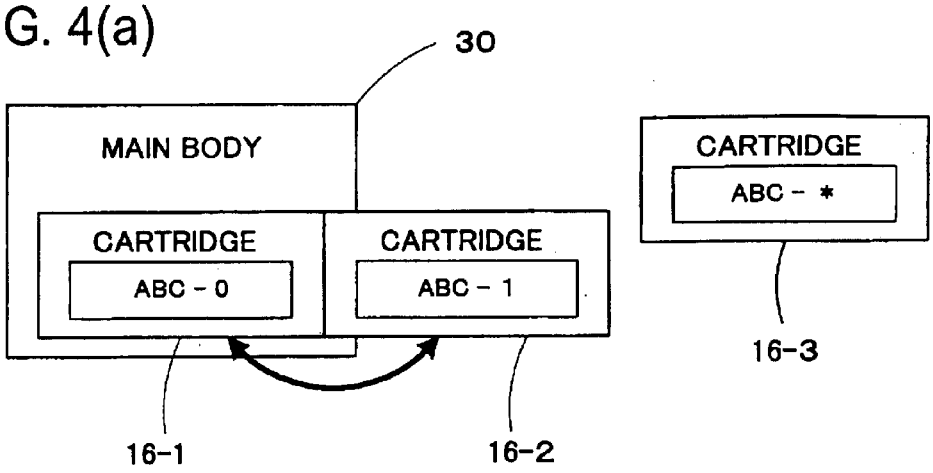
FIG. 4 is a diagram illustrating the operation principle following FIG. 3.
Figure 4B:
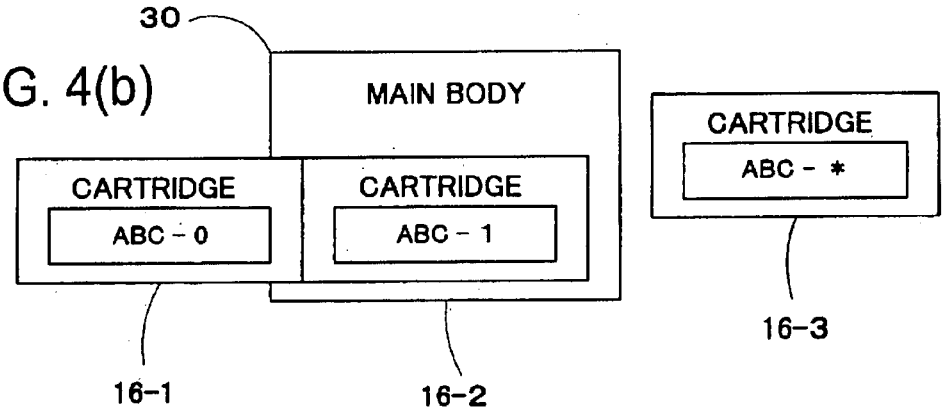
Figure 4C:
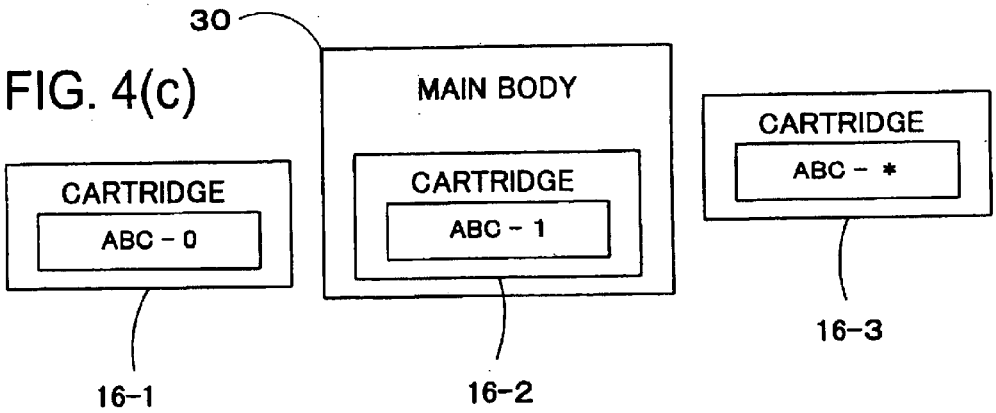

If the both user ID codes are the same, as shown in FIG. 4(*a*), the count value of the consumable supplies counter 9*b* of the RAM 9 in the main body 30 of the peripheral is set to be increased by one increment and the consumable supplies count value in the new toner cartridge 16-2 is also set to be increased by one increment. In other words, the code "ABC-1" is registered in the EEPROM of the new toner cartridge 16-2, and the new toner cartridge 16-2 is fixed in the main body 30 of the peripheral as shown in FIG. 4(*b*) to remove the old toner cartridge 16-1. The code "ABC-0" is registered in the EEPROM 16*a* of the old toner cartridge 16-1.

Furthermore, according to FIG. 4(*c*), there is no problem if both codes "ABC" are the same when the user ID code of a next toner cartridge 16-3 is checked against the user ID code of the present toner cartridge 16-2 also in the case of exchanging the toner cartridge 16-2. When the toner cartridge 16-3 is a non-genuine pirated product, the user ID codes are not the same as described above. Moreover, when the toner cartridge 16-3 is pirated and made by recycling the used toner cartridge 16-1, both count values are not the same as the consumable supplies count value is "0" in the toner cartridge 16-1 but the value becomes "1" in the main body 30 of the peripheral even if the user ID codes "ABC" are the same, so that it is determined that the cartridge is a recycled pirated product.

Sequentially, the user ID code and the consumable supplies count value are checked every time a toner cartridge is exchanged and the count value of the consumable supplies counter 9*b* of the RAM 9 in the main body 30 of the peripheral is increased by one increment and also the count value of the same toner cartridge is set to be the count value which is increased by one increment if the user ID codes are the same.

Figure 5:
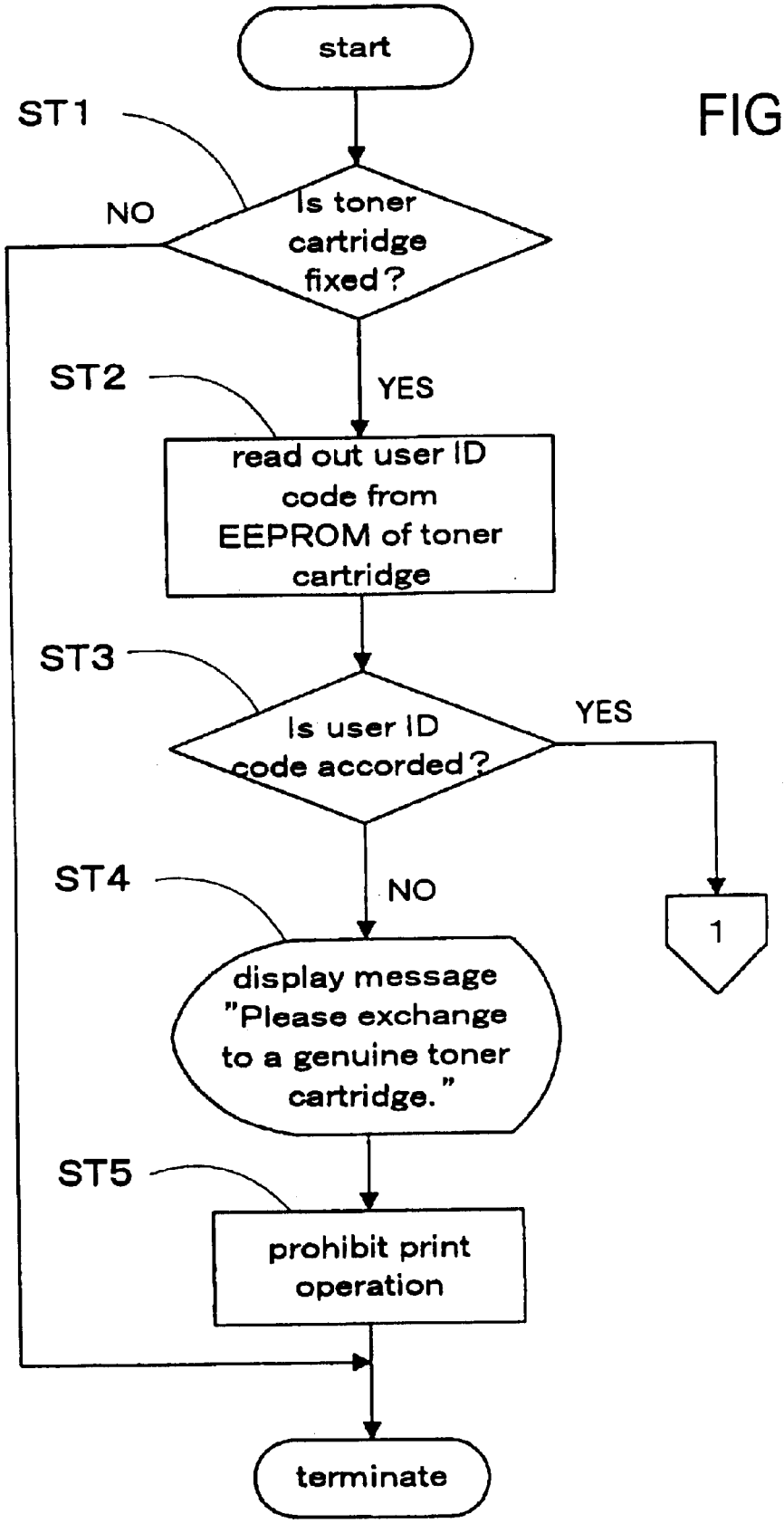
FIG. 5 is a flow chart showing an operation process in exchanging the toner cartridge (the process unit) of the image forming apparatus.

The operation in exchanging the toner cartridge 16 (the process unit) of the peripheral will be described with reference to a flow chart of FIG. 5 and FIG. 6. First, in step ST1 of FIG. 5, the MPU1 determines whether or not the toner cartridge 16 is fixed in the peripheral based on the signal from the toner cartridge fixture sensor 17, and terminates the process when the fixture is not completed. If the toner cartridge 16 is fixed, the MPU1 reads out the user ID code from the EEPROM 16*a* of the toner cartridge 16 through the print mechanism control unit 15 in the next step ST2.

In step ST3, the MPU1 determines whether or not the read-out user ID code matches the user ID code stored in the user ID code 9*a* of the RAM9 of the peripheral. If the user ID code of the cartridge 16 does not match the user ID code of the multifunction peripheral, the MPU1 commands to display a message "Please exchange to a genuine toner cartridge" in the display part 6 in step ST4, and prohibits the print operation to terminate the process in step ST5, as the pirated toner cartridge that is not the genuine product is fixed in the peripheral.

Figure 6:
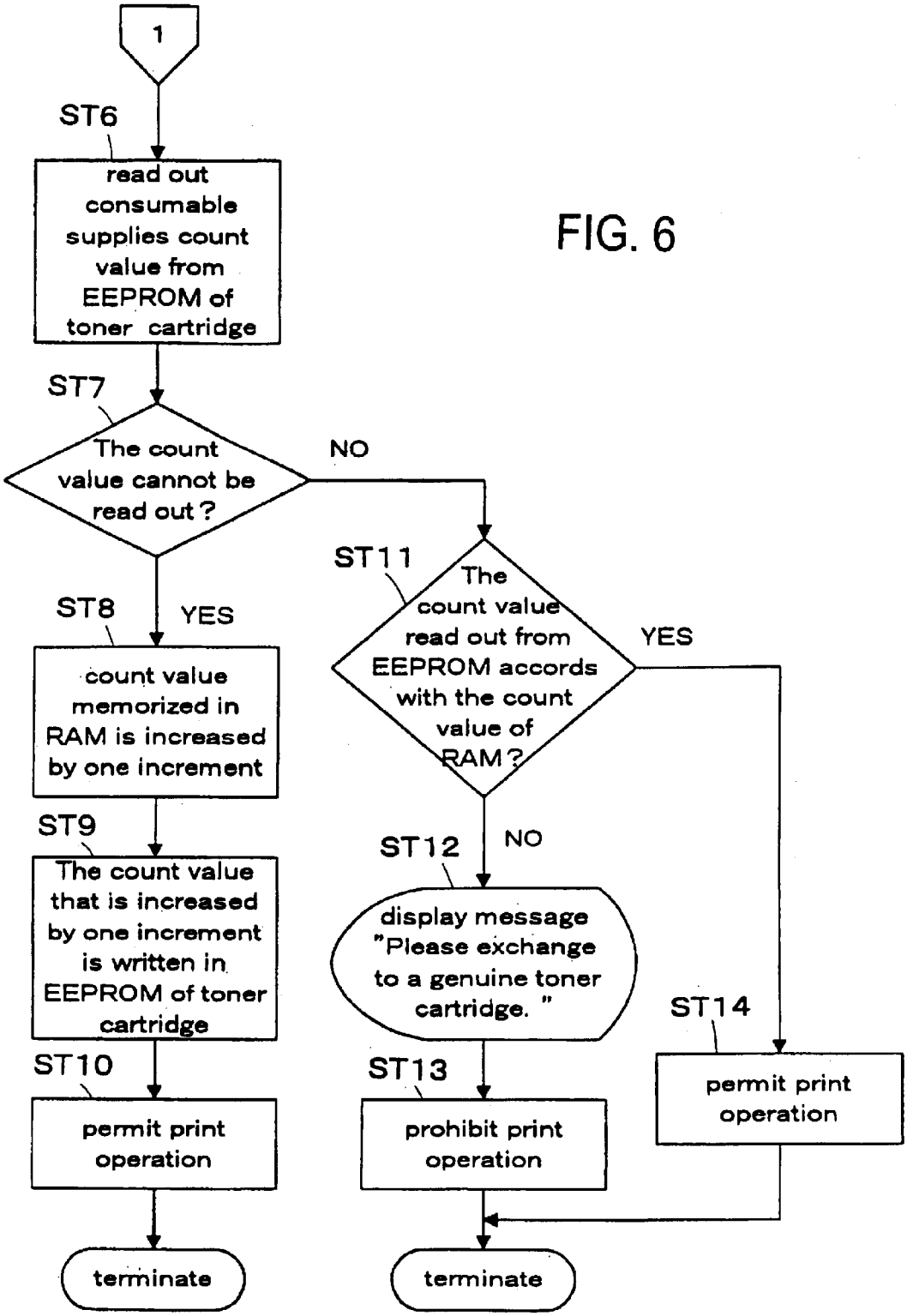
FIG. 6 is a flow chart following FIG. 5.

On the other hand, when the user ID code of the toner cartridge 16 matches the user ID code of the peripheral in step ST3 that is when a genuine toner cartridge is fixed in the peripheral, the MPU1 moves to step ST6 of FIG. 6. In step ST6, the MPU1 further reads out the consumable supplies count value using the EEPROM 16*a* of the toner cartridge 16.

The MPU1 determines whether or not the consumable supplies count value can be read out in step ST7, and makes the count value of the consumable counter 9*b* of the RAM9 increase by one increment in step ST8, if the count value cannot be read out that is the case that the toner cartridge 16 fixed in the peripheral is determined not to be the new genuine product. Sequentially, in step ST9, the MPU1 writes the count value that is increased by one increment in the EEPROM 16*a* of the toner cartridge 16 through the printer mechanism control unit 15, permits the print operation in step ST10, and terminates the process after completing a predetermined print.

Moreover, if the MPU1 can read out the consumable count value in step ST7, it moves to step ST 11. In step ST 11, the MPU1 determines whether or not the count value read out from the EEPROM 16*a* of the toner cartridge 16 matches the count value stored in the consumable supplies count value counter 9*b* of the RAM9 in the multifunction peripheral. As it is considered that the pirated toner cartridge that is the genuine product but is made by recycling the used toner cartridge is fixed in the peripheral if both count values are different, the MPU1 commands to display the message "Please exchange to the genuine toner cartridge" in the display part 6, and prohibits the print operation to terminate the process in step ST13.

However, as it is considered that the toner cartridge in use is once removed from the peripheral for jam recovery and is fixed in the peripheral again if both count values are the same, the MPU1 permits the print operation in step ST14 and terminates the process after completing a predetermined print.

Additionally, though the toner cartridge is taken as an example of the process unit in the above preferred embodiment, the drum units or the process units, etc. including all the toner cartridges and the drum units can also be applied.

Moreover, the count value is increased by one increment such as 0, 1, 2, 3, . . . in the above preferred embodiment, but a configuration such that the count value goes down by one decrement such as 0, −1, −2, −3, . . . can be also available. In the case, there is no need that an initial value of the count value is zero.

What is claimed is:

1. An image forming apparatus comprising:

a process unit inserted in and removed from the image forming apparatus, wherein the process unit includes a first memory having an identification code and a count value stored therein;

a memory access unit that accesses the first memory and reads the identification code and the count value;

a second memory that stores an identification code and a count value of the image forming apparatus; and a control unit that limits an image forming operation if the identification code stored in the first memory matches the identification code stored in the second memory and the count value stored in the first memory has a predetermined relation with the count value of the second memory;

wherein, upon the insertion of the process unit into the image forming apparatus, the identification codes of the first and second memories are compared, and if the identification codes match, the count value stored in the second memory is changed to a new count value, the new count value is stored in the first memory, and the image forming operation is allowed.

2. The image forming apparatus according to claim 1, wherein the control unit prohibits the image forming operation if the identification code stored in the first memory does not match the identification code stored in the second memory.

3. The image forming apparatus according to claim 1, wherein the control unit changes the count value stored in the second memory and the memory access unit writes the changed count value in the memory access unit when the count value is not written in the first memory in an initial state, the identification code of the first memory matches the identification code of the second memory, and the memory access unit can not read out the count value from the first memory.

4. The image forming apparatus according to claim 1, wherein the process unit is a toner cartridge.

5. The image forming apparatus according to claim 1, wherein the count value stored in the second memory is a number of operations of the process unit.

6. The image forming apparatus according to claim 1 further comprising a sensor to detect when the process unit is inserted in the image forming apparatus.

7. The image forming apparatus according to claim 1 further comprising a display to indicate the process unit is not acceptable.

8. The image forming apparatus according to claim 1, wherein the count value is registered at a service center.

9. The method according to claim 6 further comprising displaying a message to indicate the process unit is not acceptable.

10. The image forming apparatus of claim 1, wherein upon the insertion of the process unit into the image forming apparatus, if the identification codes of the first and second memories match but no count value is readable from the first memory, the image forming operation is allowed and the count values of the first and second memories are changed.

11. A process unit identification method for an image forming apparatus comprising:

reading out an identification code from a first memory;

reading out a count value from the first memory;

reading out an identification code from a second memory;

reading out a count value from the second memory;

comparing the count value read out from the second memory and the count value from the first memory;

prohibiting the image forming operation of the apparatus if both count values are in a predetermined relation;

comparing the identification code from the first memory with the identification code from the second memory; and if the identification code from the first memory matches the identification code from the second memory, changing the count value in the second memory to a new count value; storing the new count value in the first memory, and allowing the image forming operation.

12. The method according to claim 11 further comprising prohibiting the image forming operation if the count value read out from the second memory is larger than the count value read out from the first memory.

13. The method according to claim 11 further comprising:

prohibiting the image forming operation if the identification code read out from the first memory does not match the identification code read out from the second memory.

14. The method according to claim 11 further comprising providing a toner cartridge as the process unit.

15. The method according to claim 11 further comprising detecting when the process unit is inserted in the image forming apparatus.

16. The method according to claim 11 further comprising registering the count value at a service center.

17. The process identification method of claim 11 and further comprising allowing the image forming operation and changing the count values of the first and second memories if the identification codes read from the first and the second memories match but no count value is readable from the first memory.

18. An image forming apparatus comprising:

a process means inserted in and removed from the image forming apparatus, wherein the process means includes a first memory means having an identification code and a count value stored therein;

a memory access means that accesses the first memory means and reads the identification code and the count value;

a second memory means that stores an identification code and a count value of the image forming apparatus; and a control means that limits an image forming operation if the identification code stored in the first memory means matches the identification code stored in the second memory means and the count value stored in the first memory means has a predetermined relation with the count value of the second memory means;

wherein, upon the insertion of the process unit into the image forming apparatus, the identification codes stored in the first and second memory means are compared, and if the identification codes match, the count value stored in the second memory means is changed to a new count value, the new count value is stored in the first memory means, and the image forming operation is allowed.

19. The image forming apparatus according to claim 18, wherein the control means prohibits the image forming operation if the identification code stored in the first memory means does not match the identification code stored in the second memory means.

20. The image forming apparatus according to claim 18 wherein the control means changes the count value stored in the second memory means and the memory access means writes the changed count value in the memory access means when the count value is not written in the first memory means in an initial state, the identification code of the first memory means matches the identification code of the second memory means, and the memory access means can not read out the count value from the first memory means.

21. The image forming apparatus according to claim 18, wherein the process means is a toner cartridge.

22. The image forming apparatus according to claim 18, wherein the count value stored in the second memory means is a number of operations of the process means.

23. The image forming apparatus of claim 18, wherein upon the insertion of the process means into the image forming apparatus, if the identification codes of the first and second memory means match but no count value is readable from the first memory means, the image forming operation is allowed and the count values of the first and second memory means are changed.

* * * * *